US005738507A

United States Patent [19]

Mifune et al.

[11] Patent Number: 5,738,507

[45] Date of Patent: Apr. 14, 1998

[54] GAS IGNITER

[75] Inventors: Hideo Mifune; Noriyuki Serizawa; Takayuki Suzuki, all of Shizuoka-ken, Japan

[73] Assignee: Tokai Corporation, Shizuoka-ken, Japan

[21] Appl. No.: 738,887

[22] Filed: Oct. 28, 1996

[30] Foreign Application Priority Data

Nov. 9, 1995 [JP] Japan ..... 7-291136

[51] Int. Cl.[6] ..... F23D 14/28; F23D 14/48

[52] U.S. Cl. ..... 431/344; 431/345; 431/255; 126/25 B; 239/588

[58] Field of Search ..... 431/344, 255, 431/266, 345; 126/25 B; 239/588; 222/527

[56] References Cited

U.S. PATENT DOCUMENTS

| | | | |
|---|---|---|---|
| 576,702 | 2/1897 | True | 222/527 |
| 1,016,281 | 2/1912 | Lundquist . | |
| 2,737,233 | 3/1956 | Mueller | 126/25 B |
| 2,804,243 | 8/1957 | Davenport | 222/527 |
| 2,962,091 | 11/1960 | Sabel | 239/588 |
| 3,674,413 | 7/1972 | Fraser | 239/588 |
| 4,610,624 | 9/1986 | Brahn | 431/255 |
| 4,969,604 | 11/1990 | Smith | 222/527 |
| 5,369,556 | 11/1994 | Zeller | 126/25 B |
| 5,531,592 | 7/1996 | Tasi | 431/266 |

*Primary Examiner*—Carl D. Price
*Attorney, Agent, or Firm*—Baker & Botts, LLP

[57] ABSTRACT

A gas igniter comprising a main body provided with a gas tank for storing liquified gas to be used as a fuel, a front pipe in the form of a hollow bar extending from the main body, a jetting nozzle for jetting out a gas, and a gas pipe connected between the main body and the jetting nozzle. The nozzle is disposed at a front part of the front pipe At least a part of the front pipe, excluding the front part thereof where the jetting nozzle is disposed, is formed by a flexible member having a restoring force whereby it is bent so that the direction in which the front part is pointed is changed, when an external force is applied, and is restored to the original state in which it is at the time when the external force is not applied, after the external force is released.

5 Claims, 4 Drawing Sheets

GAS IGNITER

BACKGROUND OF THE INVENTION

1. Field of the Invention

The present invention relates to a gas igniter which jets a gas flame from the front end of the front pipe extending from the main body by the igniting operation of the main body, and more particularly to an improvement in the structure of the front pipe.

2. Description of the Related Art

Igniters, such as matches and lighters, have hitherto been used for igniting a combustion appliance with no automatic ignition system, such as a gas appliance, or a combustible which burns fluid fuel or solid fuel. In the case where an ignition point is located at a depth portion of an appliance, the igniting operation is difficult to perform because the distance between the flame portion and the position of a hand performing the igniting operation is short.

From the above point, a gas igniter has been put on the market and extensively used where the front pipe is extended from the main body provided with a gas tank for storing liquefied gas fuel and a gas flame is jetted from a jetting nozzle provided in the front end of the front pipe, thereby making the distance between an ignition position and an ignition operating position longer in order to easily perform ignition.

Hence, the front pipe of the gas igniter is constituted by a rigid body and is linear in shape. However, when the igniting operation is performed through the ignition hole of a gas appliance, there are cases where an unnatural operating posture has to be taken and ignition becomes difficult. Also, when an obstacle such as a wall is present on the extended line of the ignition hole, there are cases where the front end portion cannot be inserted to a normal ignition position and an increased chance of ignitionability is not obtained.

If the front pipe extending from the main body is given flexibility to cope with the aforementioned points, ignition can be performed at a predetermined position by the front pipe extending curvedly from the main body and an increased chance of ignitionability can be obtained.

As an example of a flexible pipe, a flexible member with no restoring force, which is deformed by an external force and remains deformed when the external force is removed, has been used, for example, in various kinds of hoses. It is conceivable that the flexible member with no restoring force is used in the case where a bendable and flexible pipe is applied to the aforementioned front pipe.

In the case, when a path to an objective combustible is not linearly extended from the main body (or the operating portion) of a gas igniter but is curved, the flexible front pipe is bent beforehand so as to correspond to the curved path and the igniting portion of the front pipe is moved near the ignition position to perform ignition.

However, when the previously bent front pipe is not suitably fitted, it becomes necessary to readjust the bending. When, on the other hand, the gas igniter is stored in the original place after ignition, there are cases where there is performed an operation of restoring the bent front pipe to the original linear state.

In addition, when the operation of restoring the front pipe is performed, attention must be paid to the operation, because there are cases where the temperature of the front ignition portion has become high. Moreover, when ignition and storage are repeated, the bending operation becomes necessary each time, so the operation becomes complicated.

SUMMARY OF THE INVENTION

The purpose of the present invention is to provide a gas igniter where the front pipe thereof is constituted by a flexible member so that a bending operation is made unnecessary when ignition and storage are performed.

To achieve this end, the present invention provides a gas igniter, where a front pipe in the form of a hollow bar extends from a main body provided with a gas tank for storing liquefied gas to be used as a fuel, a jetting nozzle for jetting out a gas is disposed at a front part of the front pipe, and a gas pipe is connected from the main body to the jetting nozzle. In the igniter, part or all of the front pipe, excluding the front part thereof where the jetting nozzle is disposed, is constituted by a flexible member having a restoring force due to which it is bent to change the direction of the front part, when an external force is applied, and also is restored to the state before the external force is applied, after the external force is released.

In a preferred embodiment of the invention, the flexible member is constituted by a flexible pipe formed by spirally winding molded ribbon plate members and the flexible pipe itself has a restoring force.

In another preferred embodiment of the invention, the flexible member is constituted by a flexible pipe formed by winding a linear spring member into a coil spring shape and the flexible pipe itself has a restoring force.

In still another preferred embodiment of the invention, the flexible member is constructed so that a linear or coil-shaped restoring spring is disposed interiorly of a flexible pipe whose restoring force is small.

In a further preferred embodiment of the invention, the flexible member is constructed so that a flexible member whose restoring force is small has a portion which is expanded when it is bent and deformed and that an elastic member is provided on the expandable portion.

In the aforementioned gas igniter, the front pipe can be freely curved if an external force is applied to the front end thereof, by forming a part or all of the front pipe out of a flexible member which is bent when an external force is applied and restores to the original state after the external force is removed. Even when a front linear pipe cannot easily be moved near a combustible due to an obstacle, the front pipe is bent so that the front end thereof faces the combustible, by making use of a gap into which the pipe can be inserted. With this, better ignition can be performed by an occurrence of a gas flame. In addition, the bending of the front pipe is performed by an external force and, as the front pipe is inserted making contact with an obstacle, the front pipe naturally corresponds to the insertion shape and then the front end thereof reaches an ignition point. Consequently, an operation of bending the front pipe to the insertion shape beforehand is made unnecessary, and the gas igniter of the present invention is also applicable to the case where insertion will become impossible if the front pipe is bent from the beginning. Furthermore, when the front pipe is removed after ignition, it is automatically restored to the original state by the restoring force of the flexible member, so an operation of restoring the deformation of the front pipe to the original state becomes unnecessary when the gas igniter is stored and there is no need to touch the front pipe where there is the possibility that the temperature would have risen. Thus, the present invention is excellent in operability.

BRIEF DESCRIPTION OF THE DRAWINGS

The present invention will be described in further detail with reference to the accompanying drawings, in which.

DESCRIPTION OF THE PREFERRED EMBODIMENTS

Figure 1:
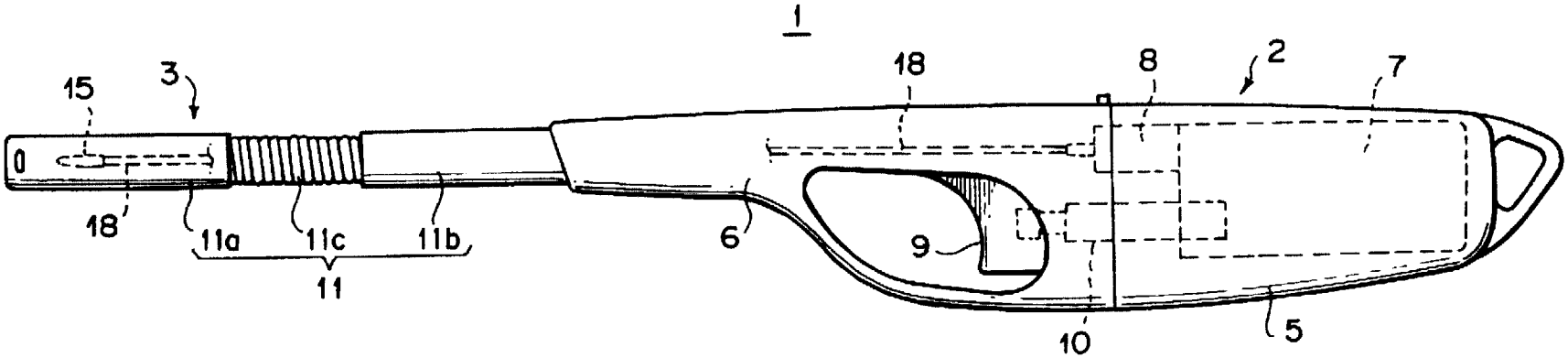
FIG. 1 is a schematic view showing a gas igniter according to an embodiment of the present invention.
Figure 2:
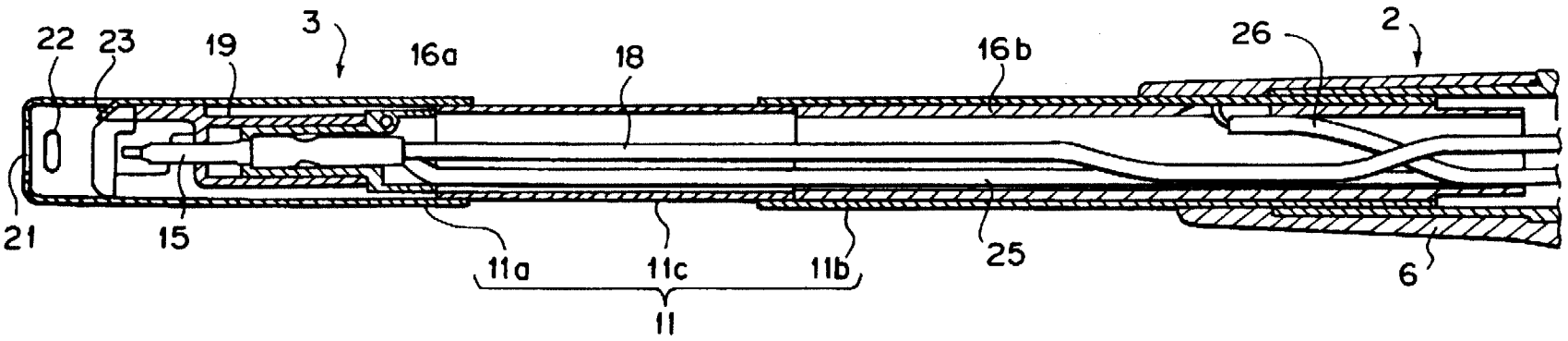
FIG. 2 is a sectional view showing the essential part of the gas igniter shown in FIG. 1.

Referring now to FIGS. 1 and 2, there is shown a preferred embodiment of a gas igniter 1 in accordance with the present invention. The gas igniter 1 comprises a main body 2 and an extended portion 3 extending in the form of a hollow bar from the main body 2.

The main body 2 includes a casing portion, which comprises a tank cover 5 and an intermediate casing 6 provided ahead of the tank cover 5. A gas tank 7 is disposed interiorly of the tank cover 5 and stores liquefied gas therein. The gas tank 7 is provided with a valve mechanism 8 for opening or closing a gas supply. An ignition lever 9 is provided interiorly of the intermediate casing 6 so that it can freely slide in the longitudinal direction of the gas igniter 1. Between the rear portion of the ignition lever 9 and the gas tank 7, there is provided a piezoelectric unit 10. The piezoelectric unit 10 supplies a discharge voltage, as the ignition lever 9 is retracted. A gas supply lever (not shown) is connected to the ignition lever 9 and, in interlock with the rearward movement of the ignition lever 9, the gas supply lever is moved so that it opens the valve mechanism 8 to supply a gas.

The aforementioned extended portion 3 is in the form of a hollow bar and the outer portion thereof is constituted by a front pipe 11 formed of conductive material, such as metal. The front pipe 11 comprises a front cylindrical portion 11*a*, an intermediate portion 11*c*, a rear cylindrical portion 11*b*. The front and rear cylindrical portion 11*a* and 11*b* are formed of rigid metal pipes, while the intermediate portion 11*c* is formed of a flexible member. Thus, the front pipe 11 is provided so as to be bendable. A jetting nozzle 15 is disposed interiorly of the front cylindrical portion 11*a* for jetting out a gas. The rear cylindrical portion 11*b* is inserted and fixed to the intermediate casing 6 of the main body 2. The front and rear cylindrical portions 11*a* and 11*b* are connected through the flexible member 11*c*.

When an external force is applied to the front cylindrical portion 11*a*, the flexible member 11 is bent and the front cylindrical portion 11*a* is varied in direction. When, on the other hand, the external force is removed, the flexible member 11*c* is restored to the original state before the external force is applied. An example of the flexible member 11*c* will be described later.

Plastic inner pipes 16*a* and 16*b*, as shown in FIG. 2, are disposed interiorly of the front and rear cylindrical portions 11*a* and 11*b* of the front pipe 11, respectively. The front end portion of the inner pipe 16*a*, disposed interiorly of the front cylindrical portion 11*a*, is reduced in diameter and the jetting nozzle 15 is inserted into the reduced portion. In the rear end of the jetting nozzle 15 the front end of the gas pipe 18 is fitted. A nozzle cover 19, formed of an insulating material such as plastic, is disposed so as to cover the front end portion of the inner pipe 16*a* and the outer peripheral portion of the jetting nozzle 15.

In the front end face of the front cylindrical portion 11*a* of the front pipe 11 there is formed a nozzle 21 through which a gas flame passes. At the rear side portion an air introduction port 22 is formed, and above the rear portion, part of the cylindrical body is bent and formed into a discharge electrode 23.

The gas pipe 18, connected to the rear end of the jetting nozzle 15, introduces a gas into the jetting nozzle 15 and is formed by flexible material. This gas pipe 18 extends rearwardly of the interior of the front pipe 11 and the rear end thereof is connected to the aforementioned valve mechanism 8. Furthermore, a flexible coated lead wire 25 is inserted into the interior of the front pipe 11. One end of the coated lead wire 25 is connected to the jetting nozzle 15 and the other end is connected to one electrode of the aforementioned piezoelectric unit 10.

An opening is provided in part of the interior of the inner pipe 16 inserted in the interior of the rear cylindrical portion 11*b* and faces the inner surface of the rear cylindrical portion 11*b*. One end of another coated lead wire 26 is connected to the rear cylindrical portion 11*b* through the aforementioned opening and the other end is connected to the other electrode of the piezoelectric unit 10. Thus, the piezoelectric unit is electrically connected from the rear cylindrical portion 11*b* through the flexible member 11*c* and the front cylindrical portion 11*a* to the discharge electrode 23.

Figure 3:
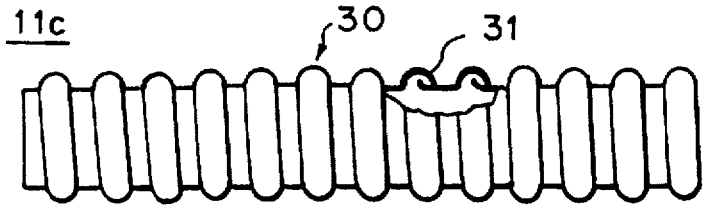
FIG. 3 is a part-sectional view showing a first example of the flexible member of FIG. 1.
Figure 4:
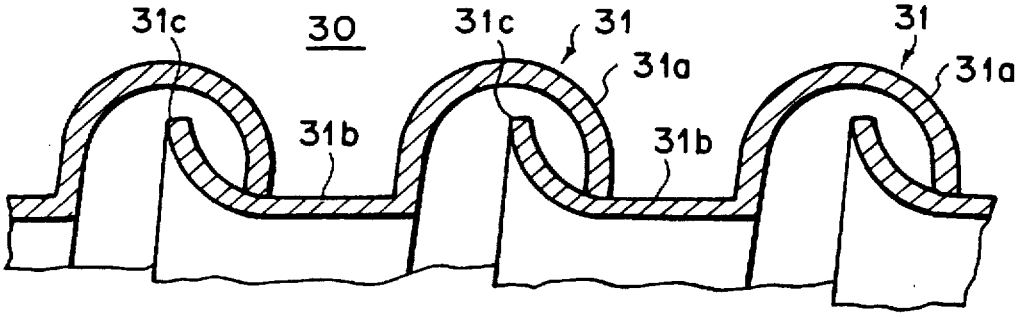
FIG. 4 is an enlarged view of the sectional portion of FIG. 3.

A first example of the flexible member 11*c* is shown in FIGS. 3 and 4. The flexible member 11*c* comprises a flexible pipe 30 formed with a plurality of projections in the form of a spiral. This flexible pipe 30 is formed by spirally winding molded ribbon plate members 31, which consist of long strips of stainless steel molded to a wave shape, so that they closely overlap one another, as shown in FIG. 4, hence giving flexibility. The flexible pipe 30 itself has a restoring force.

The sectional configuration of the molded ribbon plate member 31, as shown in FIG. 4, has a curved portion 31*a* extending outwardly in the form of a semicircle, a flat portion 31*b* extending axially from the curved portion 31*a*, and a rising portion 31*c* with its outer end portion curved outwardly. The members 31 are formed into a pipe shape by spirally winding them so that the rising portion 31*c* is inserted inside the curved portion 31*a*. Thus, the flexible member 11*c* can be bent and deformed in a range where the outer end of the rising portion 31*c* can move within the curved portion 31*a*. The engagement of the rising portion 31*c* with the inner surface of the curved portion 31*a* defines the expandable limit and the bendable limit and prevents unrestorable deformation. Thus, with this, better stability is obtained. Note that on the opposite end portions of the flexible member 11*c* there may be formed flat cylindrical connection portions which are inserted and fixed to the front and rear cylindrical portions 11*a* and 11*b*.

Now, a description will be made of the igniting operation of the gas igniter provided with the aforementioned front pipe 11. The ignition is performed by holding the main body 2 and moving the gas flame being injected from the front end to an appliance to be ignited, such as a gas appliance. When the gas igniter and the ignition point of an appliance are not in a linear relation, the front pipe 11 is inserted along an insertion path. If the front cylindrical portion 11*a* of the front pipe 11 strikes an obstacle and an external force is applied, then the flexible member 11*c* will be deformed together with the inner gas pipe 18 and coated lead wire 25 and the direction of the front cylindrical portion 11*a* will be changed. The front end of the front cylindrical portion 11*a* is moved near a predetermined ignition point and the igniting operation is performed to jet a gas flame from the nozzle 21. After ignition, the front pipe 11 is pulled out and the external force applied to the front cylindrical portion 11 is released. Then, the flexible member 11*c* is automatically restored to the original linear state by the restoring force.

When the ignition lever 9 is retracted in the aforementioned igniting operation, the valve mechanism 8 performs an opening operation in interlock with the rearward movement of the ignition lever 9 and a combustion gas is jetted from the jetting nozzle 15 provided in the front end of the extended portion 3 through the gas pipe 18. Also, the rearward movement of the ignition lever 9 causes the piezoelectric unit 10 to move rearwardly. With this, a discharge voltage (AC voltage) is generated and applied between the discharge electrode 23 of the extended portion 3 and the jetting nozzle 15 through the front pipe 11 and the coated lead wire 25. With discharge sparks being generated, ignition of the jetted gas is performed.

Figure 5:
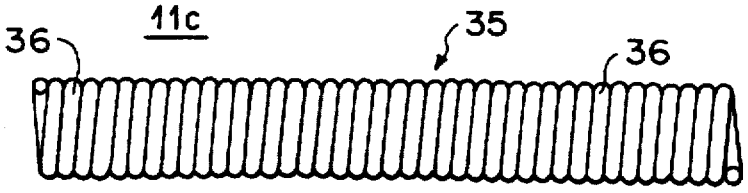
FIG. 5 is a schematic view showing a second example of the flexible member.
Figure 6:
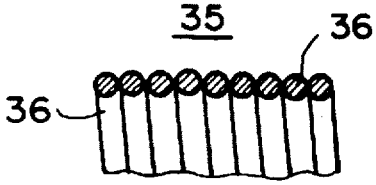
FIG. 6 is a part-sectional view of the flexible member shown in FIG. 5.

Next, in FIGS. 5 and 6 there is shown a second example of the flexible member 11*c*. The flexible member 11*c* in this example is constituted by a flexible pipe 35 formed by winding a linear spring member 36 into a coil spring shape. The flexible pipe 35 itself, as with the first example, has a restoring force.

Figure 7:
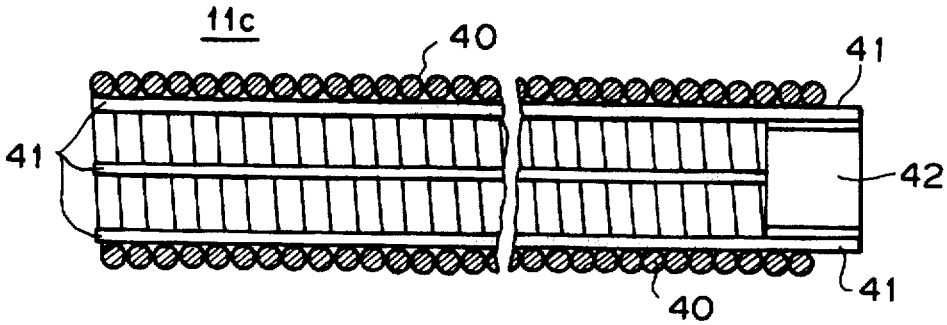
FIG. 7 is a part-sectional view showing a third example of the flexible member.
Figure 8:
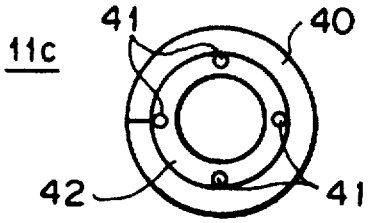
FIG. 8 is an end view showing the flexible member of FIG. 7.

In FIGS. 7 and 8 there is shown a third example of the flexible member 11*c*. This example uses a flexible pipe 40 whose restoring force is weak, which is formed by spirally winding a linear member, and disposes several linear restoring springs 41 (four in the figures) interiorly of the flexible pipe 40 in the axial direction. One end of each of the linear restoring springs 41 is fixedly supported by a support member 42, while the other end is made to be a free end and is disposed in close contact with the inner wall of the flexible pipe 40.

In the structure of the third example, when an external force is applied and the flexible pipe 40 is deformed, the restoring springs 41 are pushed and deformed, sliding on the inner surface of the flexible pipe 40, and with the external force released, the flexible pipe 40 is restored to the linear state by the restoring force of the restoring springs 41.

Guide members may be disposed on the inner surface of the flexible pipe 40 to support the restoring springs 41 so that they are slidable, and the deformation of the flexible pipe 40 may be restored to the original state by the elasticity of all restoring springs 41. Also, a spiral coil with an open pitch may be used as the aforementioned restoring spring.

Figure 9:
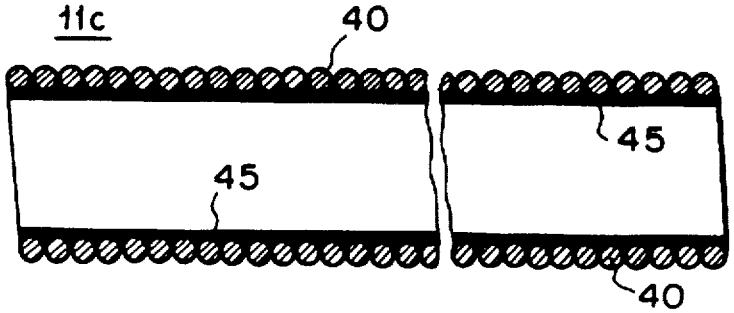
FIG. 9 is a part-sectional view showing a fourth example of the flexible member.

In FIG. 9 there is shown a fourth example of the flexible member 11*c*. This example uses an elastic member 45, such as rubber, as a restoring spring in the same structure as the aforementioned example. That is, the flexible pipe 40 whose restoring force is small is formed by spirally winding, for example, a linear member, and the inner surface (or outer surface) is coated with rubber to form the elastic member 45. When the flexible pipe 40 is bent and deformed by an external force, the flexible pipe 40 is expanded and deformed so as to pull the elastic member 45. When the external force is released, the flexible pipe 40 is restored to the linear state by the restoring elastic force of the elastic member 45.

While, in the aforementioned embodiment, the intermediate portion of the front pipe 11 has been constituted by the flexible member 11*c*, the entire portion of the front pipe 11, excluding the front cylindrical portion 11*a*, may be constituted by the flexible member 11*c*. Because there is the need for the front cylindrical portion 11*a* to hold the jetting nozzle 15 at a predetermined position to set the direction of gas jetting, it is difficult to provide the front cylindrical portion 11*a* so that it is bendable by a flexible member.

In addition, the front pipe 11, including the flexible member 11*c*, has been constructed by conductive material and the conductive path to the discharge electrode 23 has been constructed by making use of the front pipe 11. However, the present invention is not limited to this structure. When a conductive path is formed in the discharge electrode 23 or the front cylindrical portion 11*a* by a coated lead wire, the flexible member 11*c* may be constructed by nonconductive material such as plastic material and rubber material.

Therefore, the present examples and embodiments are to be considered as merely illustrative and not restrictive and the invention is not to be limited to the details given herein, but may be modified within the scope of the appended claims.

What is claimed is:

1. A gas igniter comprising:

a main body provided with a gas tank for storing liquified gas to be used as a fuel, a front pipe in the form of a hollow bar extending from said main body, a jetting nozzle for jetting out a gas, said nozzle disposed at a front part of said front pipe, and a gas pipe connected between said main body and said jetting nozzle;

wherein at least a part of said front pipe, excluding the front part thereof where said jetting nozzle is disposed, is formed by a flexible member having a restoring force permitting the flexible member to be bent so that a direction in which said front part is pointed is changed when an external force is applied to the front part of the gaspipe and to be restored automatically to an original state in which the flexible member is at the time when the external force is not applied to the front part of the gaspipe after the external force is released.

2. The gas igniter as set forth in claim 1, wherein said flexible member comprises a flexible pipe formed by spirally winding molded ribbon plate members and the flexible pipe has a restoring force.

3. The gas igniter as set forth in claim 1, wherein said flexible member comprises a flexible pipe formed by winding a linear spring member into a coil spring shape and the flexible pipe has a restoring force.

4. The gas ignited as set forth in claim 1, wherein said flexible member is formed by positioning a restoring spring inside a flexible pipe whose restoring force is small.

5. The gas igniter as set forth in claim 1, wherein said flexible member is formed by providing an elastic member on an expandable portion of a flexible pipe whose restoring force is small, said expandable portion being expanded when said flexible member is bent and deformed.

* * * * *